US007372434B2

(12) United States Patent
Kang et al.

(10) Patent No.: US 7,372,434 B2
(45) Date of Patent: May 13, 2008

(54) METHOD OF DRIVING DISCHARGE DISPLAY PANEL BY ADDRESS-DISPLAY MIXING

(75) Inventors: Kyoung-Ho Kang, Suwon-si (KR); Woo-Joon Chung, Asan-si (KR); Jin-Sung Kim, Cheonan-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 759 days.

(21) Appl. No.: 10/962,708

(22) Filed: Oct. 13, 2004

(65) Prior Publication Data

US 2005/0122285 A1 Jun. 9, 2005

(30) Foreign Application Priority Data

Oct. 14, 2003 (KR) ..... 10-2003-0071454

(51) Int. Cl.
*G09G 3/28* (2006.01)

(52) U.S. Cl. ..... 345/63; 345/60; 345/690

(58) Field of Classification Search ..... 345/41, 345/60, 63, 95, 99, 103, 204, 690
See application file for complete search history.

(56) References Cited

U.S. PATENT DOCUMENTS

| | | | | |
|---|---|---|---|---|
| 2002/0190930 | A1* | 12/2002 | Shiizaki et al. | 345/63 |
| 2003/0063062 | A1* | 4/2003 | Tsumura et al. | 345/102 |
| 2003/0169216 | A1* | 9/2003 | Chung et al. | 345/60 |

FOREIGN PATENT DOCUMENTS

| | | |
|---|---|---|
| EP | 1172787 | 1/2002 |
| JP | 7-191627 | 7/1995 |
| JP | 08-044315 | 2/1996 |
| JP | 2002-108281 | 4/2002 |

* cited by examiner

*Primary Examiner*—Amare Mengistu
*Assistant Examiner*—Vincent E. Kovalick
(74) *Attorney, Agent, or Firm*—H.C. Park & Associates, PLC

(57) ABSTRACT

In a method of driving a discharge display panel, each subfield may include a first address period, a first display-sustain period, a second address period, and a second display-sustain period. In the first address period, a predetermined wall voltage may be generated in display cells selected from the display cells of the first display electrode-line pair group. In the first display-sustain period, display-sustain discharge may occur during a time proportional to a gray scale weight of each of the subfields in the selected display cells of the display cells of the first display electrode-line pair group when the first address period has elapsed. In the second address period, a predetermined wall voltage may be generated in display cells selected from the display cells of the second display electrode-line pair group when the first display-sustain period has elapsed. In the second display-sustain period, display-sustain discharge may occur during a time proportional to a gray scale weight of each of the subfields in the selected display cells of the display cells of the first and second display electrode-line pair groups when the second address period has elapsed.

10 Claims, 8 Drawing Sheets

METHOD OF DRIVING DISCHARGE DISPLAY PANEL BY ADDRESS-DISPLAY MIXING

CROSS-REFERENCE TO RELATED APPLICATION

This application claims the priority of Korean Patent Application No. 2003-71454, filed on Oct. 14, 2003, in the Korean Intellectual Property Office, the disclosure of which is incorporated herein in its entirety by reference.

FIELD OF THE INVENTION

The present invention relates to a method of driving a discharge display panel and more particularly to a method of driving a discharge display panel by which gray-scale display is performed on a discharge display panel. In the discharge display panel there may be display electrode line pairs formed parallel to one another, as well as address electrode lines that are separate from and intersect with the display electrode line pairs. The method may employ time-division drive and may include a plurality of subfields in a unit frame.

DESCRIPTION OF THE RELATED ART

FIG. 1 shows the structure of a conventional discharge display panel, for example, a three-electrode surface-discharge type plasma display panel (PDP). FIG. 2 shows an example of a display cell of the plasma display panel (PDP) of FIG. 1. As shown in FIGS. 1 and 2, address electrode lines $A_{R1}$, $A_{G1}$, . . . , $A_{Gm}$, and $A_{Bm}$, dielectric layers 11 and 15, Y electrode lines $Y_1$, . . . , and $Y_n$, X electrode lines $X_1$, . . . , and $X_n$, a phosphor layer 16, partition walls 17, and an MgO layer 12 as a protection layer may be disposed between front and rear substrates 10 and 13 of a conventional surface-discharge plasma display panel (PDP) 1.

The address electrode lines $A_{R1}$, $A_{G1}$, . . . , $A_{Gm}$, and $A_{Bm}$ may be formed at a front side of the rear substrate 13 in the form of a predetermined pattern. The entire surface of the lower dielectric layer 15 may be coated in the front of the address electrode lines $A_{R1}$, $A_{G1}$, . . . , $A_{Gm}$, and $A_{Bm}$. The partition walls 17 may be formed at a front side of the lower dielectric layer 15 to be parallel to the address electrode lines $A_{R1}$, $A_{G1}$, . . . , $A_{Gm}$, and $A_{Bm}$. The partition walls 17 may partition off a discharge area of each display cell and may prevent optical cross-talk between the display cells. The phosphor layer 16 may be formed between the partition walls 17.

The X electrode lines $X_1$, . . . , and $X_n$ and the Y electrode lines $Y_1$, . . . , and $Y_n$ may be formed at a rear side of the front transparent substrate 10 in the form of a predetermined pattern, orthogonal to the address electrode lines $A_{R1}$, $A_{G1}$, . . . , $A_{Gm}$, and $A_{Bm}$. A corresponding display cell may be formed at cross points of the X electrode lines $X_1$, . . . , and $X_n$ and the Y-electrode lines $Y_1$, . . . , and $Y_n$. Each of the X electrode lines $X_1$, . . . , and $X_n$ and each of the Y-electrode lines $Y_1$, . . . , and $Y_n$ may be formed in such a manner that transparent electrode lines ($X_{na}$ and $Y_{na}$ of FIG. 2) formed of a transparent conductive material such as indium tin oxide (ITO) and metallic electrode lines ($X_{nb}$ and $Y_{nb}$ of FIG. 2) used in improving conductivity may be combined with one another. The front dielectric layer 11 may be formed in such a manner that the entire surface of the front dielectric layer 11 may be coated at rear sides of the X electrode lines $X_1$, . . . , and $X_n$ and the Y electrode lines $Y_1$, . . . , and $Y_n$. The protective layer 12 for protecting the PDP 1 from a strong electric field (for example, an MgO layer) may be formed in such a manner that the entire surface of the MgO layer 12 is at a rear side of the upper dielectric layer 11. A gas used in forming plasma may be sealed into a discharge space 14.

In a method of driving the conventional PDP, by which reset, addressing, and display sustain steps may be performed in a unit subfield, may be generally applied to the conventional PDP. In a reset step, charge states of all of display cells may be uniform. In an addressing step, a predetermined wall voltage may be generated in selected display cells. In a display sustain step, a predetermined AC voltage may be applied to all X and Y electrode line pairs so that discharge-sustain discharge may occur in the display cells in which the wall voltage in the addressing step is formed. In the display sustain step, plasma may be formed in a discharge space 14 (i.e., a gas layer of the selected display cells in which display-sustain discharge occurs), and a phosphor layer (16 of FIG. 1) may be excited by radiated ultraviolet rays, thereby generating light.

As shown in FIG. 3, a conventional apparatus for driving the PDP 1 shown in FIG. 1 may include an image processor 66, a controller 62, an address driver 63, an X-driver 64, and Y-driver 65. The image processor 66 may convert an external analog image signal into a digital signal and may generate internal image signals (for example, 8-bit red (R), green (G), and blue (B) image data). It may also generate a clock signal and vertical and horizontal synchronous signals. The controller 62 may generate driving control signals $S_A$, $S_Y$, and $S_X$ in response to the internal image signals generated by the image processor 66. The address driver 63 may generate display data signals by processing the address signal $S_A$ from the driving control signals $S_A$, $S_Y$, and $S_X$ generated by the controller 62. It may also apply the display data signals to address electrode lines. The X-driver 64 may process the X-driving control signal $S_X$ and may apply the X-driving control signal $S_X$ to X electrode lines. The Y-driver 65 may process the Y-driving control signal $S_Y$ and may apply the Y-driving control signal $S_Y$ to Y electrode lines.

The following may serve as an example of conventional methods for driving a discharge display panel to be performed by the conventional apparatus for driving the PDP 1. In an address-display separation drive method, an address period and a display-sustain period may be separated from each other in each subfield included in a unit frame. (see U.S. Pat. No. 5,541,618) Thus, one must wait until another X and Y electrode line pairs are addressed after each of X and Y electrode line pairs is addressed in the address period. Due to the existence of a waiting time after addressing is performed, a wall charge state of each display cell may be nonuniform. Thus, the precision of display-sustain discharge may be lowered in the display-sustain period starting from a time when the address period has elapsed.

SUMMARY OF THE INVENTION

The present invention provides a method of driving a discharge display panel that may shorten the waiting time until another X and Y electrodes line pairs are addressed after discharge cells, thereby improving the precision of display-sustain discharge in a display-sustain period starting from a time when an address period has elapsed.

The present invention also may provide a method of driving a discharge display panel by which gray-scale display may be performed using time-division drive by including a plurality of subfields in a unit frame. This may effectively prevent display-sustain discharge from occurring in selected display cells due to incomplete addressing.

The present invention may provide a method of driving a discharge display panel by which gray-scale display may be performed on a discharge display panel on which display electrode line pairs are formed in parallel to one another and address electrode lines are separated from and intersect the display electrode line pairs. The method may use time-division drive by including a plurality of subfields in a unit frame. The display electrode line pairs may be divided into at least first and second display electrode-line pair groups so that at least one display electrode line pair may be included in a display electrode-line pair group. Each of the subfields includes a first address period, a first display-sustain period, a second address period, and a second display-sustain period. In the first address period, a predetermined wall voltage may be generated in display cells selected from the display cells of the first display electrode-line pair group. In the first display-sustain period, display-sustain discharge may occur during a time proportional to a gray scale weight of each of the subfields in the selected display cells of the display cells of the first display electrode-line pair group when the first address period has elapsed. In the second address period, a predetermined wall voltage may be generated in display cells selected from the display cells of the second display electrode-line pair group when the first display-sustain period has elapsed. In the second display-sustain period, display-sustain discharge may occur during a time proportional to a gray scale weight of each of the subfields in the selected display cells of the display cells of the first and second display electrode-line pair groups when the second address period has elapsed.

According to the method of driving a discharge display panel, in each subfield, display-sustain discharge may be performed on a first display electrode-line pair group earlier than addressing to be performed on a second display electrode-line pair group. This may take place after addressing is performed on the first display electrode-line pair group. As a result, the precision of display-sustain discharge may be improved in a display-sustain period starting from a time when an address period has elapsed. This may be because a waiting time taken until all of X and Y electrode line pairs are addressed after discharge cells are addressed becomes shorter.

In addition, display-sustain periods between address periods of each of display electrode-line pair groups are proportional to the gray scale weight of each sub-field. Thus, the situation in which display-sustain discharge does not occur in selected display cells due to incomplete addressing can be prevented, as can the situation in which subfields having low gray scale weights may not appear luminous. Thus, display-sustain discharge failing to occur in the display cells in the selected display cells due to incomplete addressing can be effectively prevented.

DETAILED DESCRIPTION OF THE INVENTION

Figure 4:
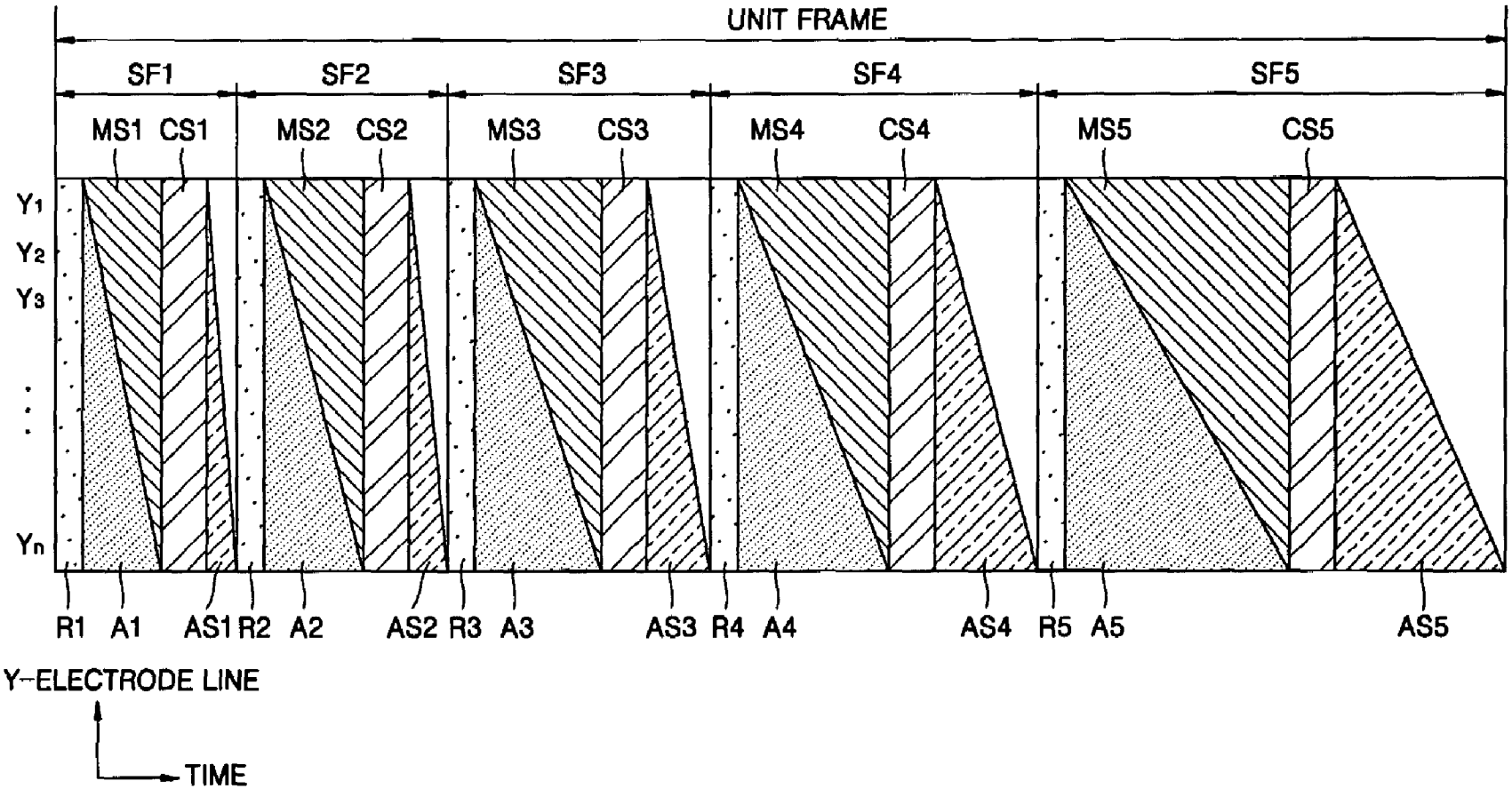
FIG. 4 is a timing diagram showing an address-display mixing drive method according to an embodiment of the present invention.

FIG. 4 shows an address-display mixing drive method according to an embodiment of the present invention. In FIG. 4, SF1 through SF5 may be subfields allocated in a unit frame. $Y_1$ through $Y_n$ may be Y electrode lines which are bases for objects to be driven. R1 through R5 may be reset periods. A1 through A5 may be address periods. MS1 through MS5 may be mixing display-sustain periods. CS1 through CS5 may be common display-sustain periods. AS1 through AS5 may be amendment display-sustain periods.

Figure 1:
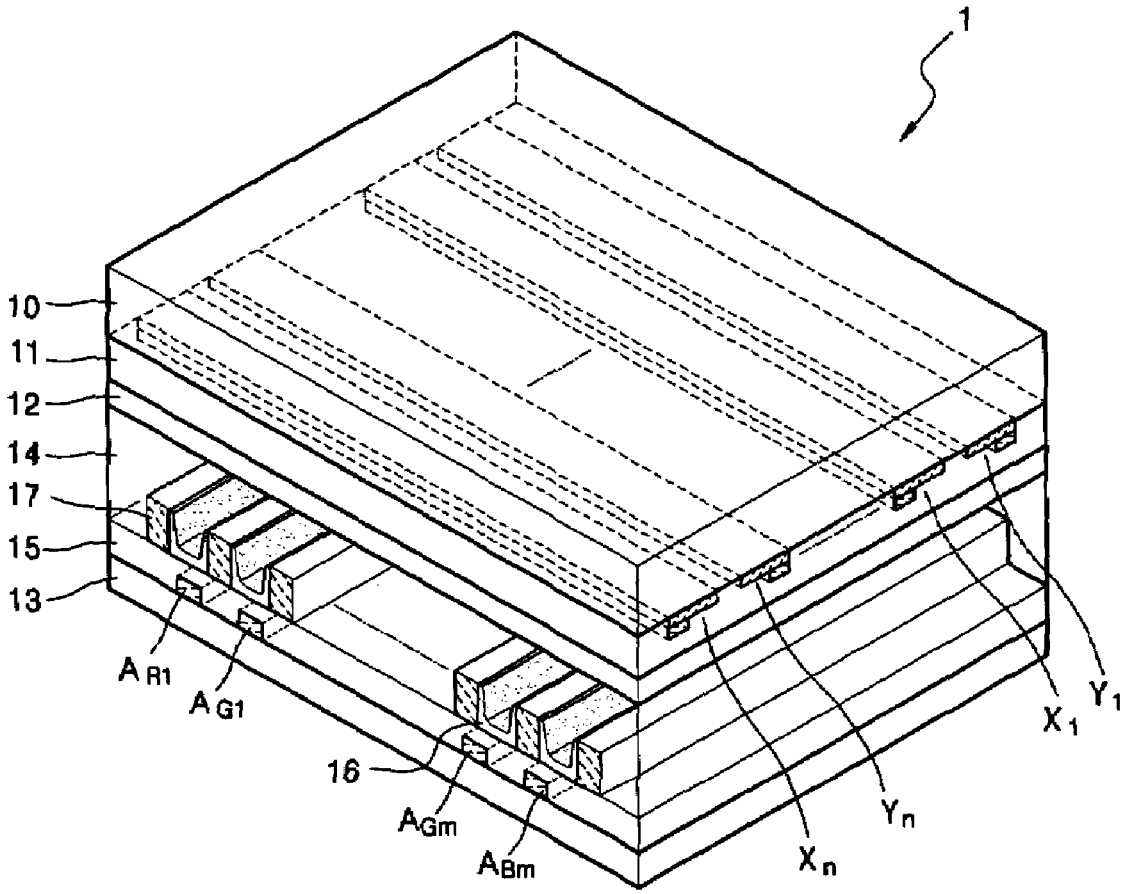
FIG. 1 (PRIOR ART)
FIG. 1 is an internal perspective view showing a structure of a conventional three-electrode surface-discharge type plasma display panel (PDP).
Figure 2:
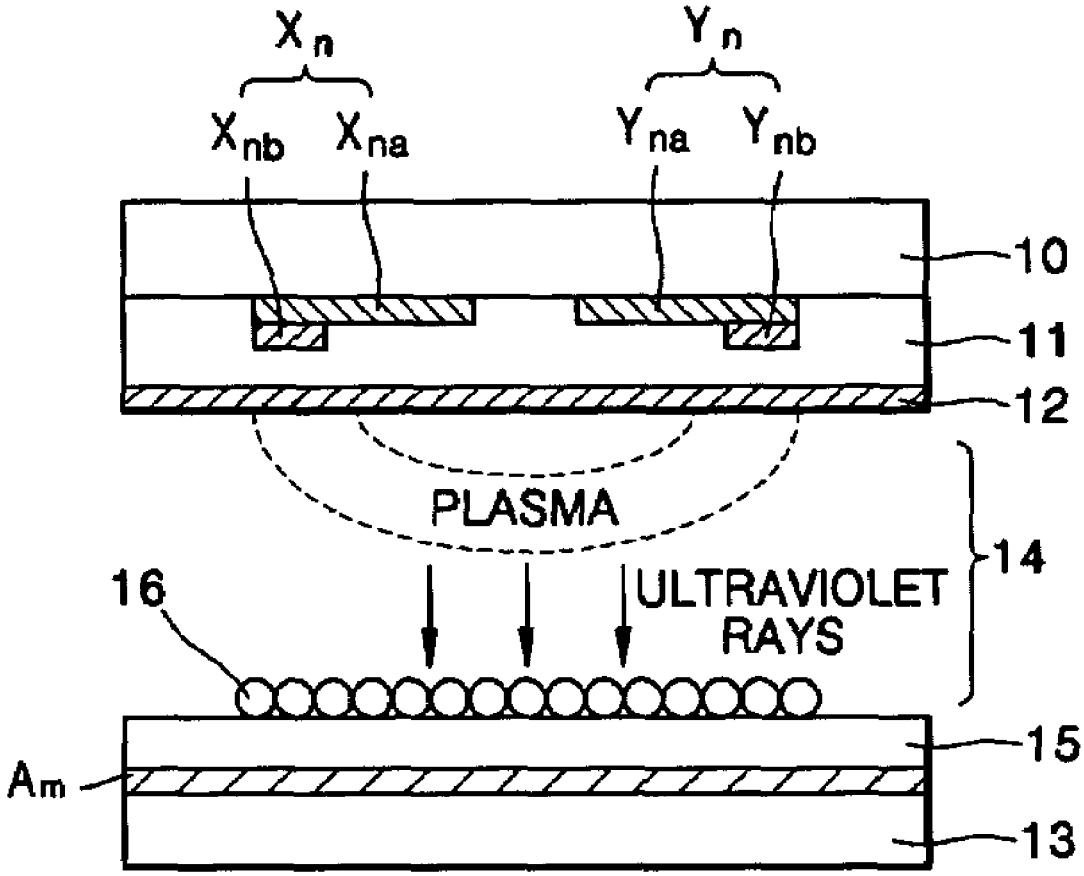
FIG. 2 (PRIOR ART)
FIG. 2 is a cross-sectional view showing an example of a display cell of the plasma display panel of FIG. 1.

As shown in FIGS. 1 and 4, each of the subfields SF1 through SF5 may include reset periods R1 through R5, mixing display-sustain periods MS1 through MS5, common display-sustain periods CS1 through CS5, and amendment display-sustain periods AS1 through AS5.

In the reset periods R1 through R5, charge states of all display cells may be uniform. In the address periods A1 through A5, a predetermined wall voltage may be generated in selected display cells. In the mixing display-sustain periods MS1 through MS5, a predetermined AC voltage may be applied to X and Y electrode line pairs in which addressing is performed. Thus display-sustain discharge may occur in display cells which are selected in address periods A1 through A5 and in which a predetermined wall voltage is generated.

Address periods A1 through A5 and mixing display-sustain periods MS1 through MS5 may have the same time frame. Thus, an addressing operation in address periods A1 through A5 and a display-sustain operation in mixing display-sustain periods MS1 through MS5 may be alternately performed. For example, in a first unit period, the addressing operation may be performed in display cells of a first Y electrode line $Y_1$. In a second unit period proportional to a gray scale weight of each of subfields SF1 through SF5, an AC voltage may be applied to first display electrode line pairs, i.e., X and Y electrode line pairs $X_1Y_1$. In a third unit period, the addressing operation may be performed in display cells of a second Y electrode line $Y_2$. In a fourth unit period proportional to the gray scale weight of each of the subfields SF1 through SF5, the AC voltage may be applied to first and second X and Y electrode line pairs $X_1Y_1$ and $X_2Y_2$. In a fifth unit period, the addressing operation may be performed in display cells of a third Y electrode line $Y_3$. In a sixth unit period proportional to the gray scale weight of each of the subfields SF1 through SF5, the AC voltage may be applied to first through third X and Y electrode line pairs $X_1Y_1$ through $X_3Y_3$. Generalizing the above procedures, the addressing operation may be performed on each of the Y electrode lines $Y_1$ through $Y_n$ in an odd-numbered unit period of the address periods A1 through A5 and the mixing display-sustain periods MS1 through MS5. Similarly, the display-sustain operation may be performed on the Y electrode line or lines in which the addressing operation is performed in an even-numbered unit time proportional to the gray scale weight of each of the subfields SF1 through SF5.

As a result, a waiting time taken until another X and Y electrode line pair is addressed after the discharge cells are addressed may become shorter. Thus the precision of display-sustain discharge may be improved in the display-sustain period starting from a time when the address period has elapsed. In addition, the display-sustain periods in the mixing display-sustain periods MS1 through MS5 may be proportional to the gray scale weight of each of the subfields SF1 through SF5. Accordingly, failure of display-sustain discharge to occur in selected display cells due to incomplete addressing can be prevented in subfields having high gray scale weights. Failure of display-sustain discharge to occur in subfields having low gray scale weights is less significant visually. Thus, failure of display-sustain discharge to occur in the selected display cells due to incomplete addressing can be effectively prevented.

Some subfields may include necessary display-sustain periods that are not filled with only the mixing display-sustain periods MS1 through MS5 with respect to all Y electrode lines $Y_1$ through $Y_n$. Such subfields may need the common display-sustain periods CS1 through CS5 and the amendment display-sustain periods AS1 through AS5. In the common display-sustain periods CS1 through CS5 set according to the necessary display-sustain period of each subfield, an AC voltage may be applied to all X and Y electrode line pairs $X_1Y_1$ through $X_nY_n$.

More specifically, a weight of the common display-sustain periods CS1 through CS5 may be weights obtained by subtracting a weight of the display-sustain periods of the first X and Y electrode line pair $X_1Y_1$ of the mixing display-sustain periods MS1 through MS5 from the gray scale weight of each subfield. In the amendment display-sustain periods AS1 through AS5, an AC voltage may be applied during different times set with respect to each of the X and Y electrode line pairs $X_1Y_1$ through $X_nY_n$ that do not fill the necessary display-sustain period of each subfield. Thus the necessary display-sustain periods may be filled with respect to all of the Y electrode lines $Y_1$ through $Y_n$.

In the case of subfields to which shorter necessary display-sustain periods are applied (not shown), the common display-sustain periods CS1 through CS5 may not be added to the subfields. However, the amendment display-sustain periods AS1 through AS5 may be added to the subfields.

Figure 5:
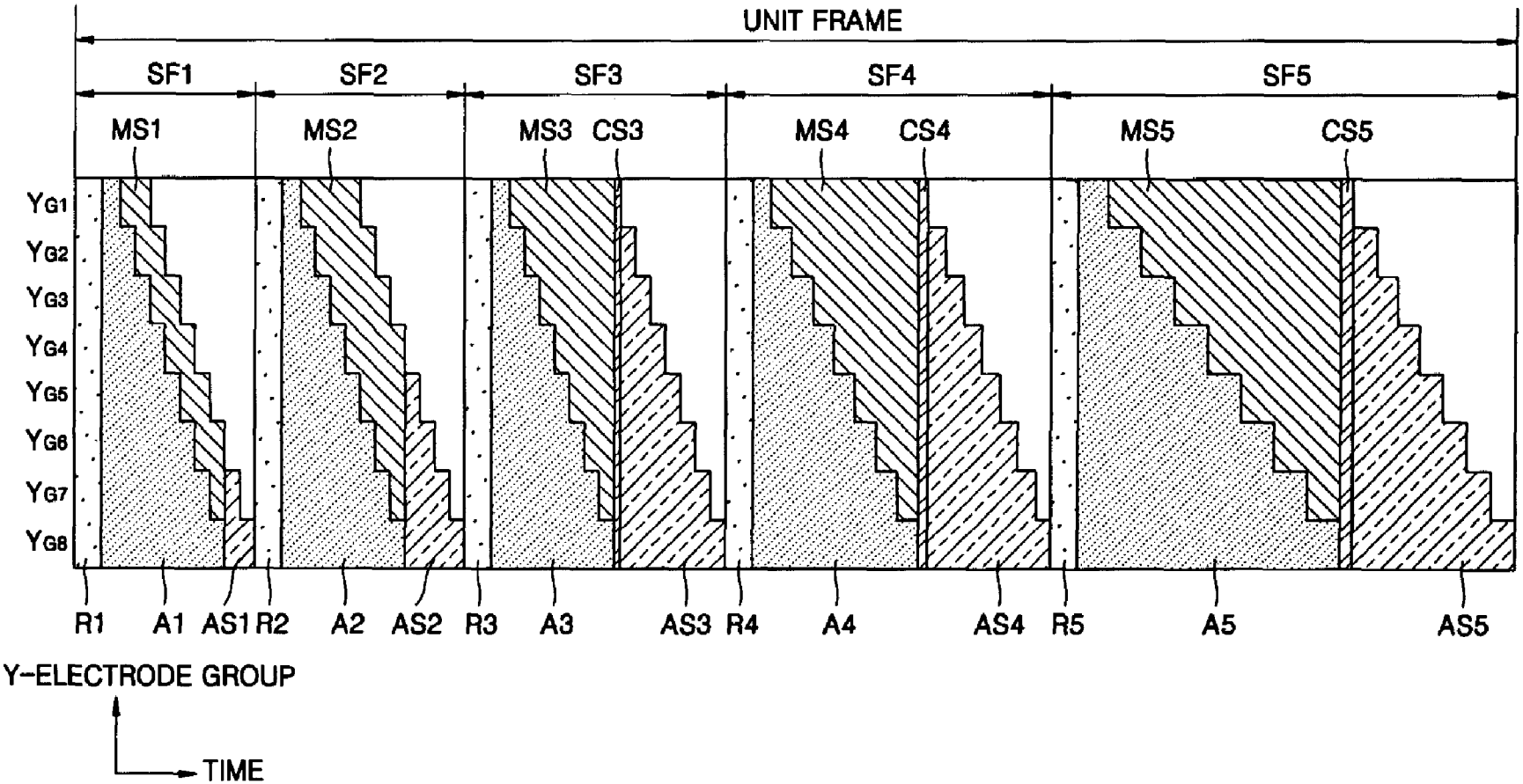
FIG. 5 is a timing diagram showing an address-display mixing drive method according to another embodiment of the present invention.

FIG. 5 shows an address-display mixing drive method according to another embodiment of the present invention. FIG. 5 uses the same numerals to represent the same functional elements as in FIG. 4. In FIG. 5, $Y_{G1}$ through $Y_{G8}$ may be display electrode-line pair groups to which Y electrode lines $Y_1$ through $Y_n$ belong. For example, when the number of the Y electrode lines $Y_1$ through $Y_n$ is 480, the first through sixtieth Y electrode lines $Y_1$ through $Y_{60}$ may belong to the first display electrode-line pair group $Y_{G1}$. The sixty-first through one-hundred twentieth Y electrode lines $Y_{61}$ through $Y_{120}$ may belong to the second display electrode-line pair group $Y_{G2}$. The one-hundred twenty-first through one-hundred eightieth Y electrode lines $Y_{121}$ through $Y_{180}$ may belong to the third display electrode-line pair group $Y_{G3}$. The one-hundred eighty-first through two-hundred fortieth Y electrode lines $Y_{181}$ through $Y_{240}$ may belong to the fourth display electrode-line pair group $Y_{G4}$. The two-hundred forty-first through three-hundredth Y electrode lines $Y_{241}$ through $Y_{300}$ may belong to the fifth display electrode-line pair group $Y_{G5}$. The three-hundred first through three-hundred sixtieth Y electrode lines $Y_{301}$ through $Y_{360}$ may belong to the sixth display electrode-line pair group $Y_{G6}$. The three-hundred sixty-first through four-hundred twentieth Y electrode lines $Y_{361}$ through $Y_{420}$ may belong to the seventh display electrode-line pair group $Y_{G7}$. The four-hundred twenty-first through four-hundred eightieth Y electrode lines $Y_{421}$ through $Y_{480}$ may belong to the eighth display electrode-line pair group $Y_{G8}$.

As shown in FIGS. 1 and 5, each of first and second subfields SF1 and SF2 may include reset periods R1 and R2, address periods A1 and A2, mixing display-sustain periods MS1 and MS2, and amendment display-sustain periods AS1 and AS2. Meanwhile, each of third through fifth subfields SF3 through SF5 may include reset periods R3 through R5, address periods A3 through A5, mixing display-sustain periods MS3 through MS5, common display-sustain periods CS3 through CS5, and amendment display-sustain periods AS3 through AS5. As shown in FIG. 4, necessary display-sustain periods shorter than those of other subfields SF3 through SF5 may be applied to each of the first and second subfields SF1 and SF2. Accordingly, the common display-sustain periods CS3 through CS5 may not be applied to each of the first and second subfields SF1 and SF2. However, the amendment display-sustain periods AS1 and AS2 may be added to each of the first and second subfields SF1 and SF2.

There may be a difference between the drive methods of FIGS. 4 and 5. In particular, the drive method of FIG. 4 may be applied in units of Y electrode lines and the drive method of FIG. 5 may be applied in units of display electrode-line pair groups.

The drive operation of the fourth subfield SF4 of the address-display mixing drive method of FIG. 5 will now be described with reference to FIG. 6. In the fourth subfield SF4 of FIG. 6, the necessary display-sustain periods with respect to all display electrode-line pair groups may be times obtained by adding seven unit times to the common display-sustain period CS4.

In the reset period R4, charge states of all display cells may be uniform. In the address period (A4 of FIG. 5) and the mixing display-sustain period (MS4 of FIG. 5) having the same time area A4MS4, an addressing operation in the address period A4 and a display-sustain operation in the mixing display-sustain period MS4 may be alternately performed.

For example, in a first unit time, an addressing step $A_{G1}$ may be performed on the first display electrode-line pair group $Y_{G1}$. In a second unit time proportional to a gray scale weight of the fourth subfield SF4, a display-sustain step $S_{11}$ may be performed on the first display electrode-line pair group $Y_{G1}$ in which addressing is performed. In a third unit time, an addressing step $A_{G2}$ may be performed on the second display electrode-line pair group $Y_{G2}$. In a fourth unit time proportional to a gray scale weight of the fourth subfield SF4, display-sustain steps $S_{12}$ and $S_{21}$ may be performed simultaneously on the first and second display electrode-line pair groups $Y_{G1}$ and $Y_{G2}$ in which addressing is performed. In a fifth unit time, an addressing step $A_{G3}$ may be performed on the third display electrode-line pair group $Y_{G3}$. In a sixth unit time proportional to a gray scale weight of the fourth subfield SF4, display-sustain steps $S_{13}$, $S_{22}$, and $S_{31}$ may be performed simultaneously on the first through third display electrode-line pair groups $Y_{G1}$ through $Y_{G3}$ in which addressing is performed.

Generalizing the above procedures, in the address period (A4 of FIG. 5) and the mixing display-sustain period (MS4 of FIG. 5) having the same time area A4MS4, the addressing operation may be performed on each of the display electrode-line pair groups $Y_{G1}$ through $Y_{G8}$ in each odd-numbered unit time $T_A$. Similarly, the display-sustain operation may be performed on the display electrode-line pair group or groups in which the addressing operation is performed, in each even-numbered unit time $T_I$ proportional to the gray scale weight of the fourth subfield SF4.

In the common display-sustain period CS4 set according to the necessary display-sustain period of the fourth subfield SF4, the display-sustain operation may be performed on all display electrode-line pair groups $Y_{G1}$ through $Y_{G8}$. Thus, an AC voltage may be applied to all X and Y electrode line pairs $X_1Y_1$ through $X_nY_n$. More specifically, the common display-sustain period CS4 of the fourth subfield SF4 may have a weight obtained by subtracting a weight of the display-sustain period $7T_I$ of the first display electrode-line pair group $Y_{G1}$ of the mixing display-sustain period MS4 from the gray scale weight of the fourth subfield SF4.

In the amendment display-sustain period AS4, an AC voltage may be applied during different times set with respect to each of display electrode-line pair groups that do not fill the necessary display-sustain period of the fourth subfield SF4. Thus, the necessary display-sustain periods may be filled with respect to all of the display electrode-line pair groups.

More specifically, in a first unit time of the amendment display-sustain period AS4, display-sustain steps may be performed simultaneously on the second through eighth display electrode-line pair groups $Y_{G2}$ through $Y_{G8}$. In a second unit time thereof, display-sustain steps may be performed simultaneously on the third through eighth display electrode-line pair groups $Y_{G3}$ through $Y_{G8}$. In a third unit time thereof, display-sustain steps may be performed simultaneously on the fourth through eighth display electrode-line pair groups $Y_{G4}$ through $Y_{G8}$. In a fourth unit time thereof, display-sustain steps may be performed simultaneously on the fifth through eighth display electrode-line pair groups $Y_{G5}$ through $Y_{G8}$. In a fifth unit time thereof, display-sustain steps may be performed simultaneously on the sixth through eighth display electrode-line pair groups $Y_{G6}$ through $Y_{G8}$. In a sixth unit time thereof, display-sustain steps may be performed simultaneously on the seventh and eighth display electrode-line pair groups $Y_{G7}$ and $Y_{G8}$. Last, in a seventh unit time thereof, a display-sustain step may be performed on the eighth display electrode-line pair group $Y_{G8}$.

Figure 3:
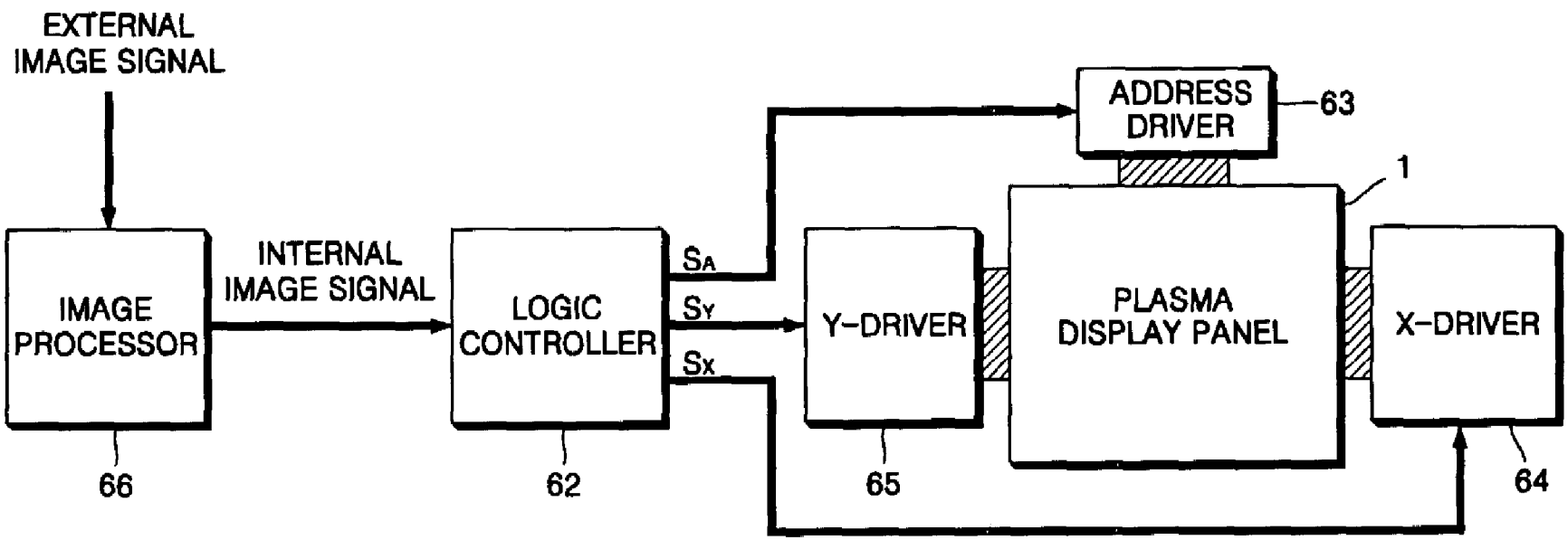
FIG. 3 (PRIOR ART)
FIG. 3 is a block diagram showing a structure of a conventional apparatus for driving the plasma display panel of FIG. 1.
Figure 6:
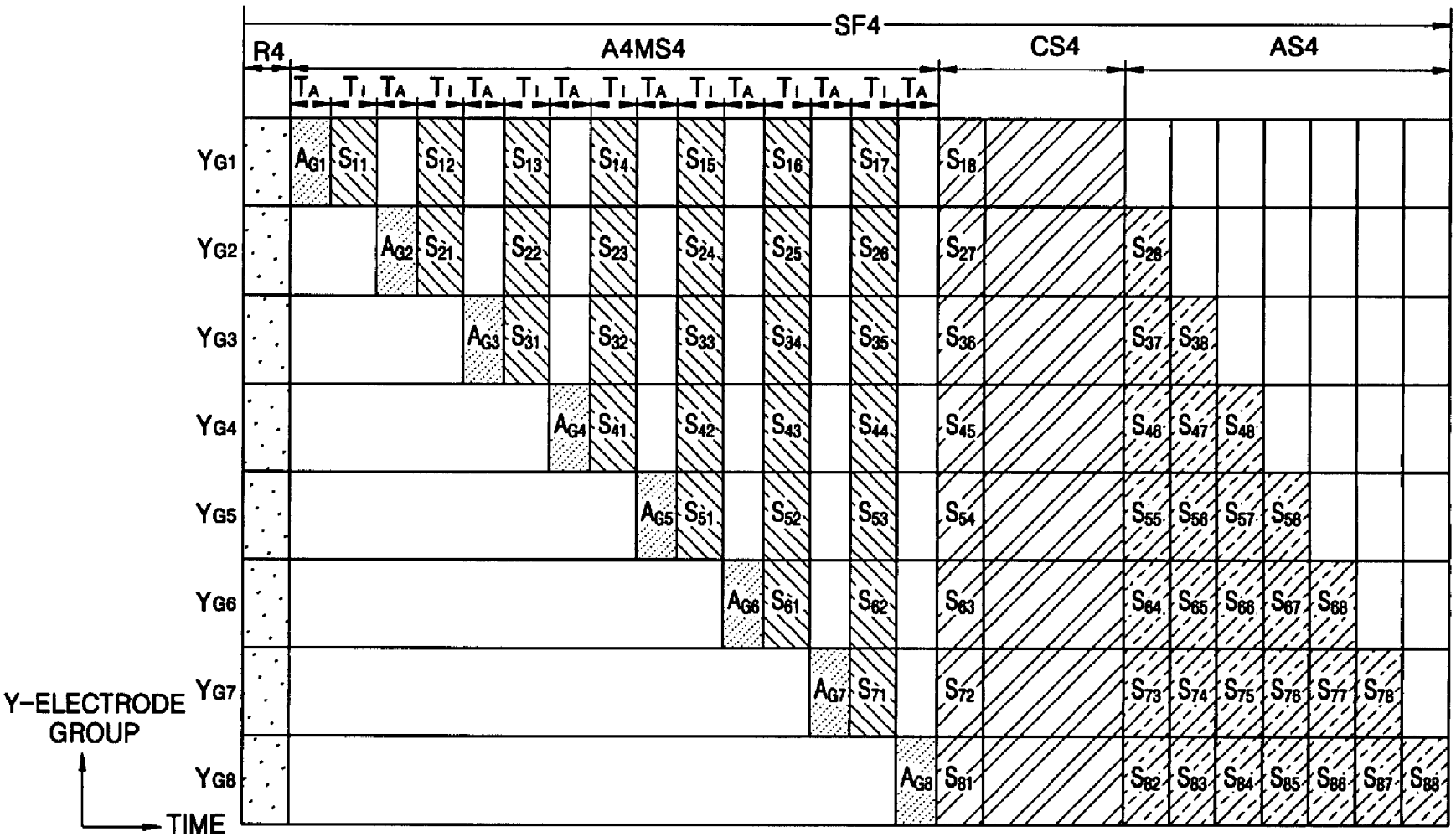
FIG. 6 is a timing diagram showing a fourth subfield in greater detail in the address-display mixing drive method of FIG. 5.
Figure 7:
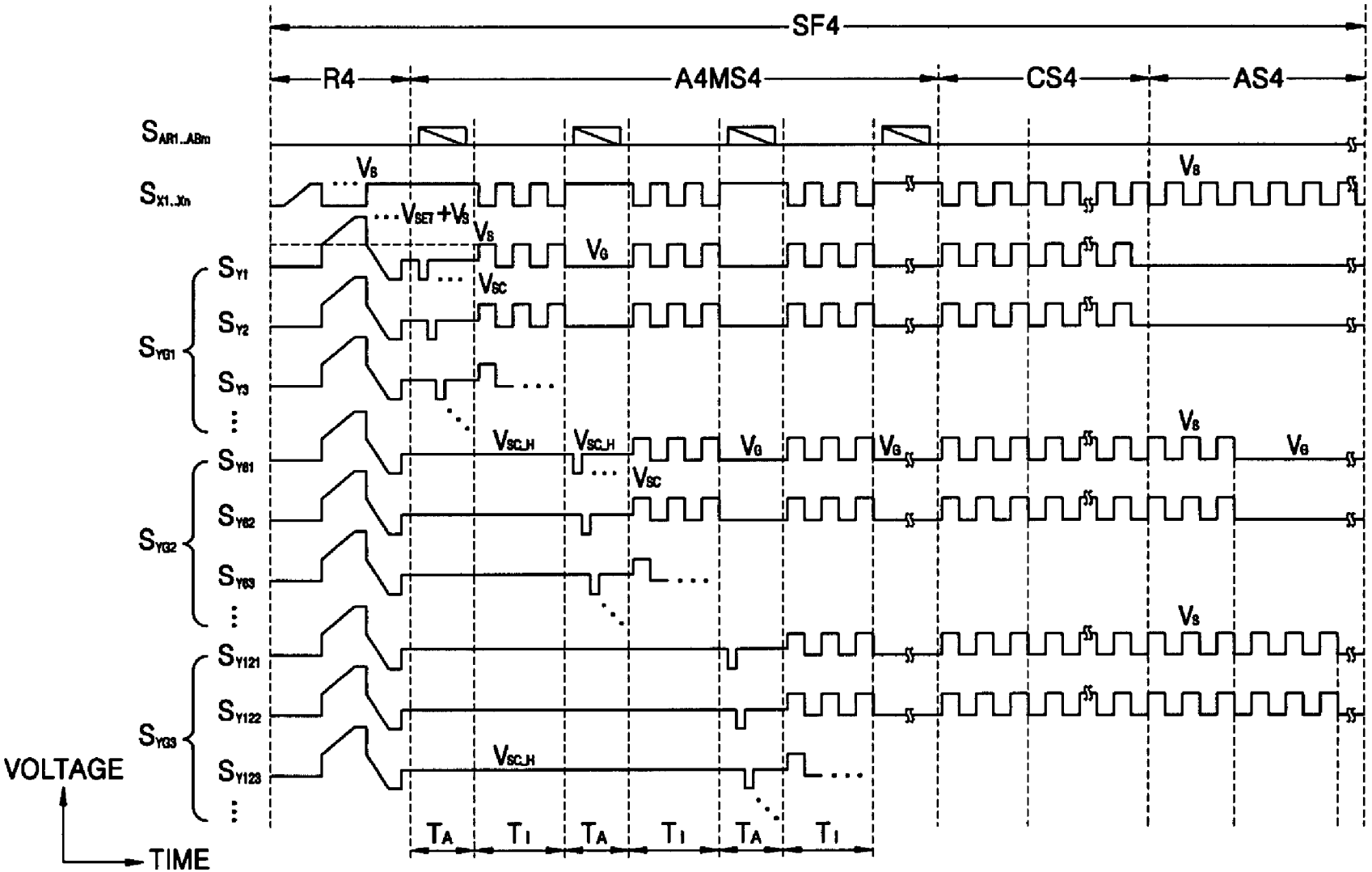
FIG. 7 is a timing diagram showing voltage waveforms of driving signals applied to each of electrode lines in the fourth subfield of FIG. 6.

FIG. 7 shows voltage waveforms of driving signals applied to each of electrode lines in the fourth subfield SF4 of FIG. 6. In FIG. 7, $S_{AR1 \ldots ABm}$ may be display data signals applied to address electrode lines ($A_{R1}$ through $A_{Bm}$ of FIG. 1) from the address driver (63 of FIG. 3). $S_{X1}$ through $S_{Xn}$ may be driving signals applied to all X electrode lines ($X_1, \ldots$, and $X_n$ of FIG. 1) from the X-driver (64 of FIG. 3). $S_{YG1}$ through $S_{YG3}$ may be driving signals applied to Y electrode lines of each display electrode-line pair group from the Y-driver (65 of FIG. 3). R4 may be a reset period. A4MS4 may be a time when the address period (A4 of FIG. 5) and the mixing display-sustain period (MS4 of FIG. 5) coexist. CS4 may be a common display-sustain period. AS4 may be an amendment display-sustain period.

The operation of the fourth subfield SF4 of FIG. 6 will now be described in greater detail with reference to FIGS. 1, 6, and 7. First, the operation of the reset period R4 will be described in detail.

In a first time of the reset period R4, a voltage applied to the X electrode lines $X_1, \ldots$, and $X_n$ may continuously increase from a ground voltage $V_G$ to a second voltage $V_s$. In such a case, the ground voltage $V_G$ as a third voltage may be applied between the Y electrode lines $Y_1, \ldots$, and $Y_n$ as second display electrode lines and address electrode lines $A_{R1}, \ldots$, and $A_{Bm}$. As a result, weak discharge may occur between the X electrode lines $X_1, \ldots$, and $X_n$ as first display electrode lines and the Y electrode lines $Y_1, \ldots$, and $Y_n$. Weak discharge may also occur between the X electrode lines $X_1, \ldots$, and $X_n$ and address electrode lines $A_1, \ldots$, and $A_m$. Simultaneously, wall charges having negative polarity may be formed around the X electrode lines $X_1, \ldots$, and $X_n$.

In a second time as a wall charge accumulation time of the reset period R4, a voltage applied to the Y electrode lines $Y_1, \ldots$, and $Y_n$ may continuously rise from the second voltage $V_s$ to a first voltage ($V_{SET}+V_s$) that is higher than the second voltage $V_s$ by a sixth voltage $V_{SET}$. In such a case, the ground voltage $V_G$ as a third voltage may be applied between the X electrode lines $X_1, \ldots$, and $X_n$ and the address electrode lines $A_{R1}, \ldots$, and $A_{Bm}$. As a result, weak discharge may occur between the Y electrode lines $Y_1, \ldots$, and $Y_n$ and the X electrode lines $X_1, \ldots$, and $X_n$. Weaker discharge may occur between the Y electrode lines $Y_1, \ldots$, and $Y_n$ and the address electrode lines $A_{R1}, \ldots$, and $A_{Bm}$. Here, discharge that occurs between the Y electrode lines $Y_1, \ldots$, and $Y_n$ and the X electrode lines $X_1, \ldots$, and $X_n$ may be stronger than discharge that occurs between the Y electrode lines $Y_1, \ldots$, and $Y_n$ and the address electrode lines $A_{R1}, \ldots$, and $A_{Bm}$. This may be because wall charges having negative polarity may be formed around the X electrode lines $X_1, \ldots$, and $X_n$.

Figure 8:
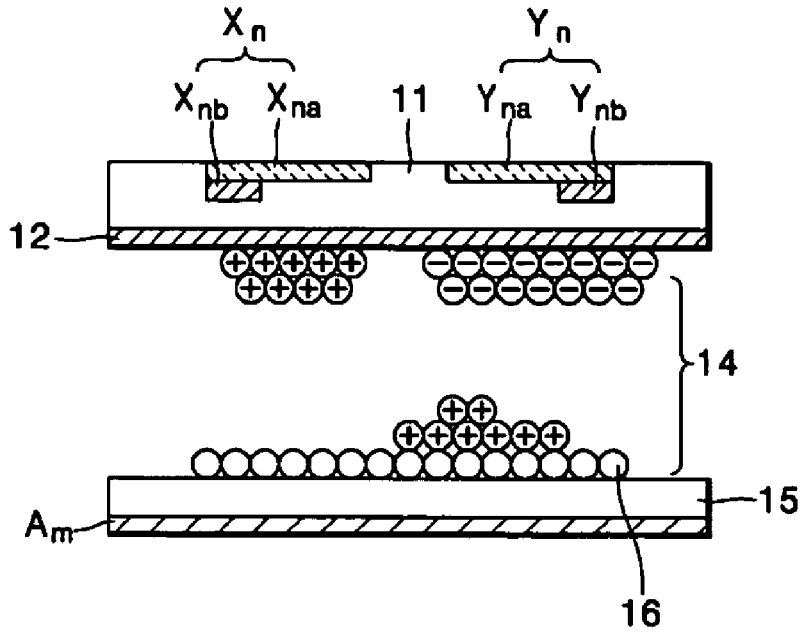
FIG. 8 is a cross-sectional view showing distribution of wall charge of a display cell immediately after a gradual rising voltage is applied to Y electrode lines in a reset period of FIG. 7.
Figure 9:
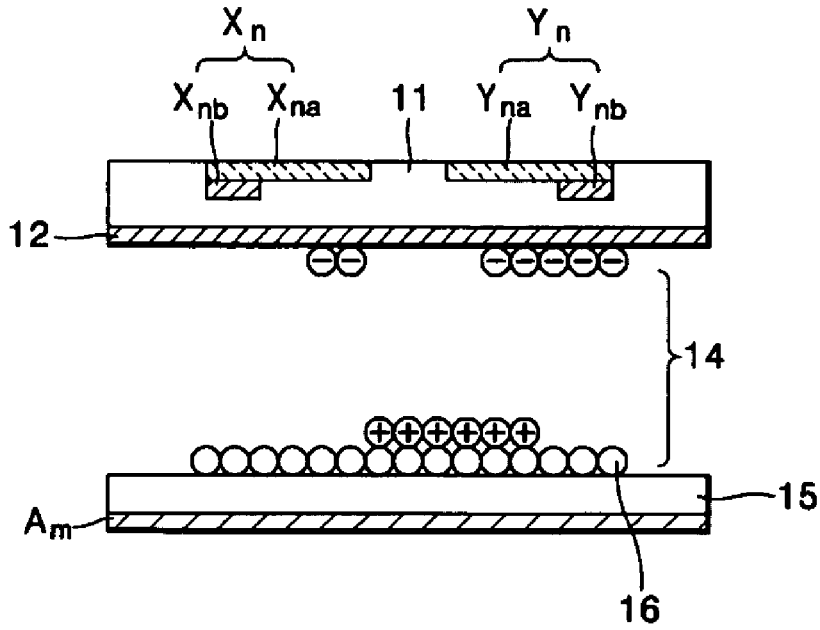
FIG. 9 is a cross-sectional view showing distribution of wall charge of a display cell at a time when the reset period of FIG. 7 has elapsed.

Accordingly, many wall charges having negative polarity may be formed around the Y electrode lines $Y_1, \ldots$, and $Y_n$. Wall charges having positive polarity may be formed around the X electrode lines $X_1, \ldots$, and $X_n$. Small wall charges having positive polarity may be formed around the address electrode lines $A_{R1}, \ldots$, and $A_{Bm}$ (see FIG. 8).

In a third time as a wall charge distribution time of the reset period R4, a voltage applied to the Y electrode lines $Y_1, \ldots$, and $Y_n$ falls from the second voltage $V_s$ to a negative-polarity voltage $V_{SC}$ continuously in a state where the voltage applied to the X electrode lines $X_1, \ldots$, and $X_n$ is maintained at the second voltage $V_s$. Here, the ground voltage $V_G$ is applied to the address electrode lines $A_{R1}, \ldots$, and $A_{Bm}$. As a result, due to weak discharge that occurs between the X electrode lines $X_1, \ldots$, and $X_n$ and the Y electrode lines $Y_1, \ldots$, and $Y_n$, a part of wall charges having negative polarity formed around the Y electrode lines $Y_1, \ldots$, and $Y_n$ moves around the X electrode lines $X_1, \ldots$, and $X_n$.

As a result, the wall electric-potential of the X electrode lines $X_1, \ldots$, and $X_n$ may be lower than that of the address electrode lines $A_{R1}, \ldots$, and $A_{Bm}$. Similarly, the wall electric-potential of the X electrode lines $X_1, \ldots$, and $X_n$ may be higher than that of the Y electrode lines $Y_1, \ldots$, and $Y_n$. As a result, an address voltage needed in opposite discharge between the address electrode lines $A_{R1}, \ldots$, and $A_{Bm}$ selected in a continuous address period A and the Y electrode lines $Y_1, \ldots$, and $Y_n$ may be lowered.

In the address period A4 and the mixing display-sustain period (MS4 of FIG. 5) having the same time area A4MS4, the addressing operation in the address period A4 and the display-sustain operation in the mixing display-sustain period MS4 may be performed alternately.

In a first unit time $T_A$, the addressing step $A_{G1}$ may be performed on the first display electrode-line pair group $Y_{G1}$. To this end, a scan voltage of the negative-polarity voltage $V_{SC}$ may be sequentially applied to Y electrode lines of the first display electrode-line pair group $Y_{G1}$ when the voltage applied to all of the X electrode lines $X_1, \ldots,$ and $X_n$ is maintained at the second voltage $V_s$. Simultaneously, display data signals may be applied to the address electrode lines $A_{R1}, \ldots,$ and $A_{Bm}$. As a result, a predetermined wall voltage may be generated in selected display cells of the first display electrode-line pair group $Y_{G1}$. More specifically, a positive-polarity wall electric-potential may be formed around Y electrodes of the selected display cells. Similarly, a negative-polarity wall electric-potential may be formed around address electrodes. A positive-polarity bias voltage $V_{SC_H}$ applied to all of the Y electrode lines $Y_1, \ldots,$ and $Y_n$ during the scan voltage may not be applied to the Y electrode lines of the first display electrode-line pair group $Y_{G1}$.

In a second unit time $T_I$ proportional to the gray scale weight of the fourth subfield SF4, a display-sustain step $S_{11}$ may be performed on the first display electrode-line pair group $Y_{G1}$ in which addressing is performed. To this end, an AC voltage may be applied to the X electrode lines and the Y electrode lines of the first display electrode-line pair group $Y_{G1}$. More specifically, a pulse of the second voltage $V_s$ may be alternately applied to the Y electrode lines and the X electrode lines of the first display electrode-line pair group $Y_{G1}$. Thus, the number of alternately applied pulses to the Y electrode lines and the X electrode lines of the first display electrode-line pair group $Y_{G1}$ in the second unit time $T_I$ (that is, the number of discharges), may be proportional to the gray scale weight of the fourth subfield SF4.

In a third unit time $T_A$, an addressing step $A_{G2}$ may be performed on a second display electrode-line pair group $Y_{G2}$. Similarly, in a fourth unit time $T_I$ proportional to the gray scale weight of the fourth subfield SF4, display-sustain steps $S_{12}$ and $S_{21}$ may be performed simultaneously on the first and second display electrode-line pair groups $Y_{G1}$ and $Y_{G2}$ in which addressing is performed. In a fifth unit time, an addressing step $A_{G3}$ may be performed on the third display electrode-line pair group $Y_{G3}$. In a sixth unit time proportional to the gray scale weight of the fourth subfield SF4, display-sustain steps $S_{13}$, $S_{22}$, and $S_{31}$ may be performed simultaneously on the first through third display electrode-line pair groups $Y_{G1}$ through $Y_{G3}$ in which addressing is performed.

In the common display-sustain period CS4 set according to the necessary display-sustain period of the fourth subfield SF4, a display-sustain operation may be performed on all of the display electrode-line pair groups. That is, an AC voltage may be applied to all of X and Y electrode line pairs $X_1Y_1$ through $X_nY_n$.

In the amendment display-sustain period AS4, an AC voltage may be applied during different times set with respect to display electrode-line pair groups that do not fill the necessary display-sustain period of the fourth subfield SF4. Thus, the necessary display-sustain period may be filled with respect to all of the display electrode-line pair groups. For example, in a first unit time of the amendment display-sustain period AS4, display-sustain steps may be performed simultaneously on the second through eighth display electrode-line pair groups $Y_{G2}$ through $Y_{G8}$.

Since only the ground voltage $V_G$ may be applied to the Y electrode lines of the first display electrode-line pair group $Y_{G1}$, display-sustain discharge may not occur in the first display electrode-line pair group $Y_{G1}$.

In a second unit time of the amendment display-sustain period AS4, display-sustain steps may be performed simultaneously on the third through eighth display electrode-line pair groups $Y_{G3}$ through $Y_{G8}$. Here, since only the ground voltage $V_G$ may be applied to the Y electrode lines of the first display electrode-line pair group $Y_{G1}$, display-sustain discharge may not occur in the first and second display electrode-line pair groups $Y_{G1}$ and $Y_{G2}$.

As described above, in the method of driving a discharge display panel according to the present invention, in each subfield, display-sustain discharge may be performed on a first display electrode-line pair group earlier than addressing to be performed on a second display electrode-line pair group. This may occur after addressing is performed on the first display electrode-line pair group. A waiting time taken until all of X and Y electrode line pairs are addressed after discharge cells are addressed may decrease. Thus the precision of display-sustain discharge may be improved in a display-sustain period starting from a time when an address period has elapsed.

In addition, since display-sustain periods between address periods of each of display electrode-line pair groups may be proportional to the gray scale weight of each sub-field, failure of display-sustain discharge to occur in selected display cells due to incomplete addressing can be prevented. Subfields having low gray scale weights with incomplete addressing do not incur observable luminous defects. Thus, failure of display-sustain discharge to occur in the selected display cells due to incomplete addressing can be effectively prevented.

While the present invention has been particularly shown and described with reference to exemplary embodiment thereof, various changes in form and details may be made and should not be excluded from the scope of the invention.

What is claimed is:

1. A method of driving a discharge display panel by which gray-scale display is performed on a discharge display panel, comprising:

using time-division drive by including a plurality of subfields in a unit frame, wherein each of the subfields comprises:

a first address period in which a predetermined wall voltage is generated in display cells selected from display cells of a first display electrode-line pair group;

a first display-sustain period in which display-sustain discharge occurs during a time proportional to a gray scale weight of each of the subfields in the selected display cells of the display cells of the first display electrode-line pair group when the first address period has elapsed;

a second address period in which a predetermined wall voltage is generated in display cells selected from display cells of a second display electrode-line pair group when the first display-sustain period has elapsed; and a second display-sustain period in which display-sustain discharge occurs during a time proportional to a gray scale weight of each of the subfields in the selected display cells of the display cells of the first and second display electrode-line pair groups when the second address period has elapsed.

2. The method of claim 1, wherein in the first display-sustain period, AC pulses are applied to the display cells of the first display electrode-line pair group.

3. The method of claim 2, wherein the number of discharges that occur in the selected display cells of the first display electrode-line pair group is proportional to the gray scale weight of each of the subfields because of the AC pulses.

4. The method of claim 1, wherein in the second display-sustain period, AC pulses are applied to the display cells of the first and second display electrode-line pair groups.

5. The method of claim 4, wherein the number of discharges that occur in the selected display cells of the first and second display electrode-line pair groups is proportional to the gray scale weight of each of the subfields because of the AC pulses.

6. The method of claim 1, wherein each of the subfields further comprises a reset period in which charge states of all of the display cells of the at least first and second display electrode-line pair groups are uniform before the address period starts.

7. The method of claim 1, wherein each of the subfields further comprises a common display-sustain period in which display-sustain discharge occurs in the selected display cells of the display cells of the first and second display electrode-line pair groups during a time obtained by subtracting the first and second display-sustain periods from a time of the gray scale weight of each of the sub-fields when the second display-sustain period has elapsed.

8. The method of claim 7, wherein each of the subfields further comprises an amendment time in which display-sustain discharge occurs in the selected display cells of the display cells of the second display electrode-line pair group during a time proportional to the gray scale weight of each of the sub-fields when the common display-sustain period has elapsed.

9. The method of claim 1, wherein each of the subfields further comprises an amendment time in which display-sustain discharge occurs in the selected display cells of the display cells of the second display electrode-line pair group during the time proportional to the gray scale weight of each of the sub-fields when the second display-sustain period has elapsed.

10. A method of driving a discharge display panel by which gray-scale display is performed on a discharge display panel, comprising:

using time-division drive by including a plurality of subfields in a unit frame, dividing display electrode line pairs into n (in which n is greater than 1) display electrode-line pair groups so that at least one display electrode line pair is included in a display electrode-line pair group, wherein each of the subfields comprises:

an $(n-1)^{th}$ address period in which a predetermined wall voltage is generated in display cells selected from the display cells of an $(n-1)^{th}$ display electrode-line pair group;

an $(n-1)^{th}$ display-sustain period in which display-sustain discharge occurs during a time proportional to a gray scale weight of each of the subfields in the selected display cells of the display cells of the $(n-1)^{th}$ display electrode-line pair group when the $(n-^{1})^{th}$ address period has elapsed;

an $n^{th}$ address period in which a predetermined wall voltage is generated in display cells selected from the display cells of an $n^{th}$ display electrode-line pair group when the $(n-1)^{th}$ display-sustain period has elapsed; and an $n^{th}$ display-sustain period in which display-sustain discharge occurs during a time proportional to a gray scale weight of each of the subfields in the selected display cells of the display cells of the $(n-1)^{th}$ and $n^{th}$ display electrode-line pair groups when the $n^{th}$ address period has elapsed.

* * * * *